US006047881A

United States Patent [19]

Clements et al.

[11] Patent Number: 6,047,881

[45] Date of Patent: Apr. 11, 2000

[54] CONTEST CONTAINER BLANK

[75] Inventors: Charlie Clements, Chester; Gary Lapnow; Alicia Shelton, both of Richmond, all of Va.; Deanna Dixon-Sievers, Chicago, Ill.; Weston R. Wilson, Arvada, Colo.

[73] Assignee: Graphic Packaging Corporation, Paoli, Pa.

[21] Appl. No.: 09/036,033

[22] Filed: Mar. 6, 1998

[51] Int. Cl.[7] ..... B65D 25/34

[52] U.S. Cl. ..... 229/116.1; 229/118; 229/902; 229/906; 206/459.5; 206/831

[58] Field of Search ..... 229/116.1, 118, 229/902, 906; 206/459.5, 831; 40/312

[56] References Cited

U.S. PATENT DOCUMENTS

| | | | |
|---|---|---|---|
| Re. 33,503 | 12/1990 | Schluger | 229/459.5 |
| 1,299,645 | 4/1919 | Whitmore | 40/316 |
| 3,109,252 | 11/1963 | Schellenberg | 206/459.5 X |
| 3,147,856 | 9/1964 | Lightner et al. | 206/831 |
| 3,205,603 | 9/1965 | Brumley | 206/459.5 X |
| 3,389,850 | 6/1968 | Rockefeller | 206/831 X |
| 3,958,744 | 5/1976 | Herglotz | 206/831 X |
| 4,004,691 | 1/1977 | Wihksne | 206/495.5 X |
| 4,432,153 | 2/1984 | Bachman et al. | 40/424 |
| 4,472,896 | 9/1984 | Brauner et al. | 206/459.5 X |
| 4,485,926 | 12/1984 | Lenzmeier | 229/602 |
| 5,007,578 | 4/1991 | Simone | 229/459.5 X |
| 5,341,923 | 8/1994 | Arasin | 206/459.5 |
| 5,697,549 | 12/1997 | Yocum | 229/400 |

*Primary Examiner*—Gary E. Elkins
*Assistant Examiner*—Tri M. Mai
*Attorney, Agent, or Firm*—Klaas, Law, O'Meara & Malkin, P.C.; William P. O'Meara, Esq.; Joseph J. Kelly, Esq.

[57] ABSTRACT

A device for use in participating in a contest wherein the device has a first layer integral with and superposed over a second layer having an outer surface on which spaced apart contest indicia are illustrated and a third layer superposed over and secured to the second layer to cover the contest indicia. The third layer is provided with openable cover portions which are located so that, when opened, the contest indicia will be exposed. The device preferably comprises a closed container which may be opened and filled with an edible product.

11 Claims, 3 Drawing Sheets

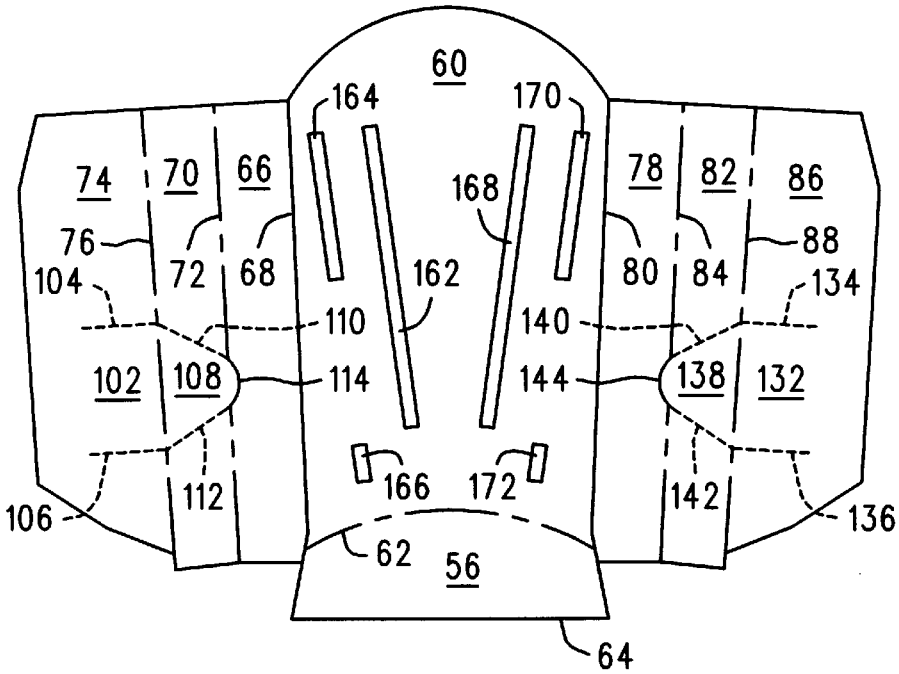
FIG. 3
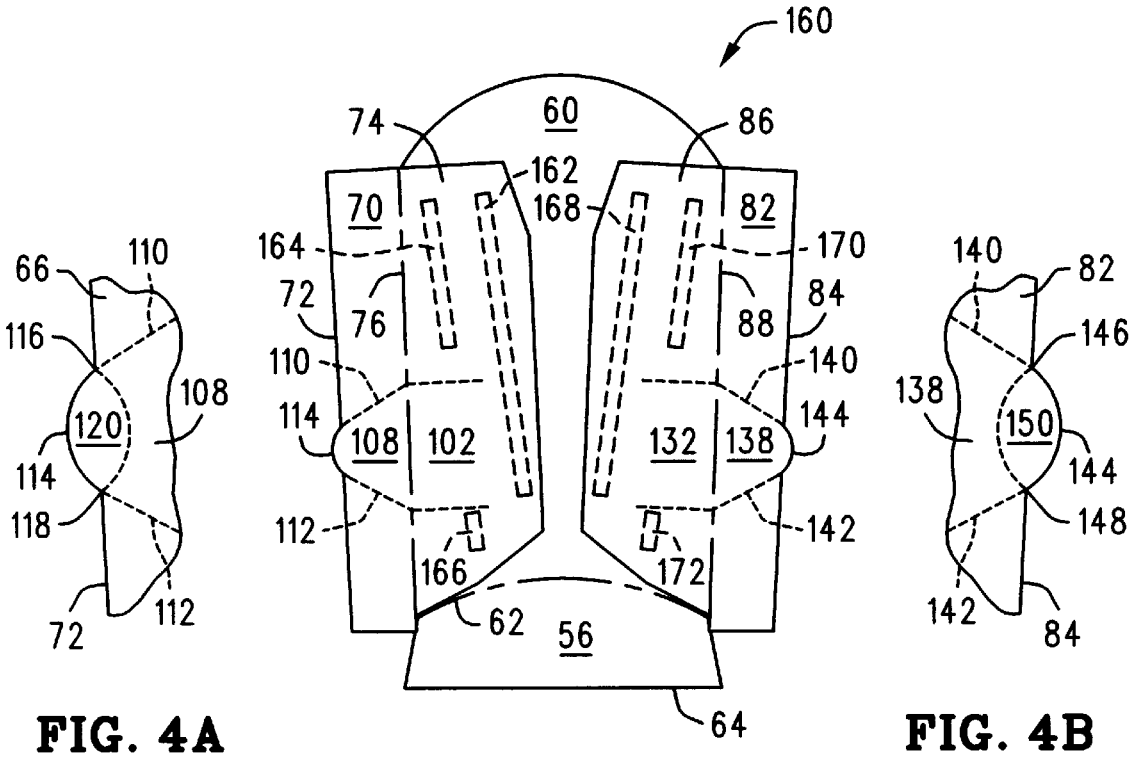
FIG. 4A
FIG. 4B
FIG. 4

CONTEST CONTAINER BLANK

FIELD OF THE INVENTION

This invention relates generally to a container blank and the closed containers formed therefrom and more particularly to container blanks and closed containers and other objects formed therefrom which are to be used in participating in a potential prize awarding contest.

BACKGROUND OF THE INVENTION

There are many different approaches to promoting a new product or generating interest in an old product. One type of promotional campaign is to use a contest that is participated in by the purchasing public. In one type of campaign, indicia are printed on the back panel of a carton or container and covered by a removable cover that is removed preferably with the aid of scissors. The indicia advises the purchaser of prize awarding details. While there have been many different types of promotional campaigns, there always remains a type of promotional campaign that will generate interest.

BRIEF DESCRIPTION OF THE INVENTION

This invention provides a container blank that can be formed into a usable container that has provided thereon prize winning indicia that are only visible after openable cover portions on the container are opened. Also, the inventive concepts can be used with other types of objects or devices.

In a preferred embodiment of the invention, the container blank comprises a unitary sheet formed from a container forming material and having a plurality of cut and fold lines formed therein to form a container blank. The container blank has a front panel portion having an inner surface; a bottom panel portion integral with the front panel portion and projecting outwardly from a first portion of the front panel portion; a back panel portion integral with the bottom panel portion and projecting outwardly therefrom; a first plurality of panel portions comprising at least one sidewall panel portion and at least one glue panel portion joined together by fold lines and integral with and projecting outwardly from a second portion of the front panel portion; a second plurality of panel portions comprising at least one sidewall panel portion and at least one glue panel portion joined together by fold lines and integral with and projecting outwardly from a third portion of the front panel portion, and the back panel portion has an inner surface facing the inner surface of the front panel portion and an outer surface. The outer surface has at least one but preferably at least two contest indicium illustrated thereon at spaced apart locations. At least one openable cover portion is formed in at least one of the first and second plurality of panel portions and when two contest indicium are provided, in each of the first and second plurality of panel portions and is located to overlie one of the at least two spaced apart contest indicium when the container blank is folded and secured together to form a closed container.

Each of the openable cover portions comprises a pair of spaced apart perforated lines that can be separated by the application of a sufficient force thereto, and having a first end portion, a second end portion and an arcuate cut line that extends between each of the second end portions.

In a specific embodiment of the invention, each of the first and second plurality of panel portions comprise two sidewall panel portions and a glue panel portion. When the container blank is folded to form a closed container, the two sidewall panel portions of each of the first and second plurality of panel portions are in a superposed relationship and each glue panel portion overlies a portion of the back panel portion. Each of the two openable cover portions comprises two parallel spaced apart perforated lines in the glue panel portion, two spaced apart converging perforated lines in the adjacent sidewall panel portion and an arcuate cut line in the next adjacent sidewall panel. The cut line provides a pull tab to be used in opening each of the at least two openable cover portions.

As described above, the contest indicia are illustrated on the outer surface of the back panel portion. However, if desired, the contest indicia could be located on the inner surface of each of the at least two openable cover portions.

In operation, a salesperson will receive an order from a customer. An individual closed container will be opened by applying a sufficient force on appropriate portions thereof and filled with the desired product, such as french fried potatoes. Instructions for playing the contest can be described on the container and/or be displayed in some manner associated with the salesperson. When the customer is finished, the customer will apply an appropriate force on each of the pull tabs to open the at least two openable cover portions to observe the indica to determine whether or not a prize has been won.

BRIEF DESCRIPTION OF THE DRAWINGS

An illustrative and presently preferred embodiment of the invention is illustrated in the accompanying drawings in which:

FIG. 3 is a plan view of FIG. 2 after a first folding operation;

FIG. 4 is a plan view of a closed container formed from the container blank of FIG. 2;

FIG. 4A is an enlarged view of a portion of FIG. 4;

FIG. 4B is an enlarged view of another portion of FIG. 4;

DETAILED DESCRIPTION OF THE INVENTION

Figure 1:
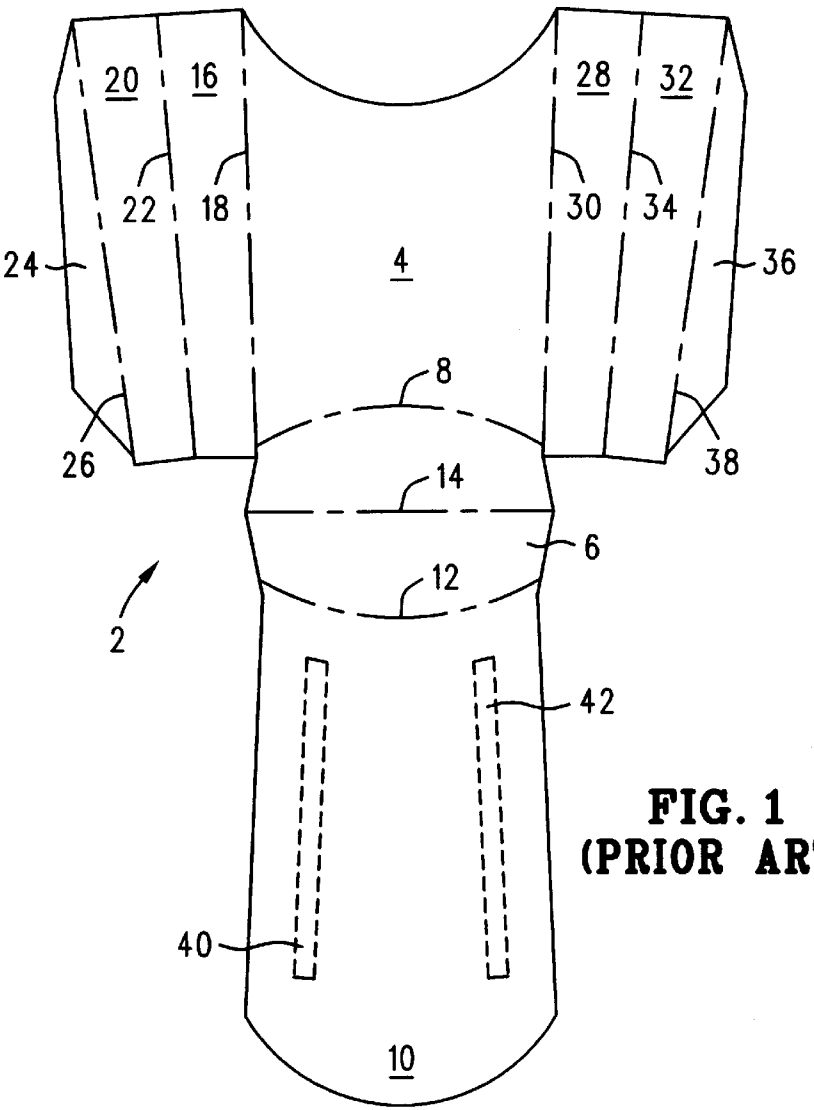
FIG. 1 (PRIOR ART)
FIG. 1 is a plan view of a container blank of the prior art.

In FIG. 1, there is illustrated a container blank 2 of the prior art. The container blank 2 has a front panel portion 4, a bottom panel portion 6 integral with the front panel portion 4 and joined thereto by a fold line 8. A back panel portion 10 is integral with the bottom panel portion 6 and is joined thereto by a fold line 12. The bottom panel portion 6 also has a fold line 14. A sidewall panel portion 16 is integral with the front panel portion 4 and is joined thereto by a fold line 18. A sidewall panel portion 20 is integral with the sidewall panel portion 16 and is joined thereto by a fold line 22. A glue panel portion 24 is integral with the sidewall panel portion 20 and is joined thereto by a fold line 26. A sidewall panel portion 28 is integral with the front panel portion 4 and is joined thereto by the fold line 30. A sidewall panel portion 32 is integral with the sidewall panel portion 28 and is joined thereto by a fold line 34. A glue panel portion 36 is integral with the sidewall panel portion 32 and is joined thereto by a fold line 38.

A closed container is formed from the container blank 2 by folding the back panel portion 10 and part of the bottom panel portion 6 around the fold line 14 so that portions of the back panel portion 10 overlie the front panel portion 4. The sidewall panel portion 20 and the glue panel portion 24 are folded around the fold line 22 so that the sidewall panel portion 20 overlies the sidewall panel portion 16 and the glue panel portion 24 overlies a portion of the back panel portion 10. The sidewall panel portion 32 and the glue panel portion 36 are folded around the fold line 34 so that the sidewall panel portion 32 overlies the sidewall panel portion 28 and the glue panel portion 36 overlies another portion of the back panel portion 10. The glue panel portions 24 and 36 are joined to the superposed portions of the back panel portion 10 by a suitable conventional adhesive indicated by the lines 40 and 42.

The closed container is opened by pushing inwardly on fold lines 22 and 34 to form an open cavity between the front panel 4 and the back panel 10 and the sidewall panel portions 16, 20, 28 and 32 and upwardly on the fold line 14 to form the bottom panel for the cavity. The opened container is then filled with a desired product, preferably french fried potatoes.

Figure 2:
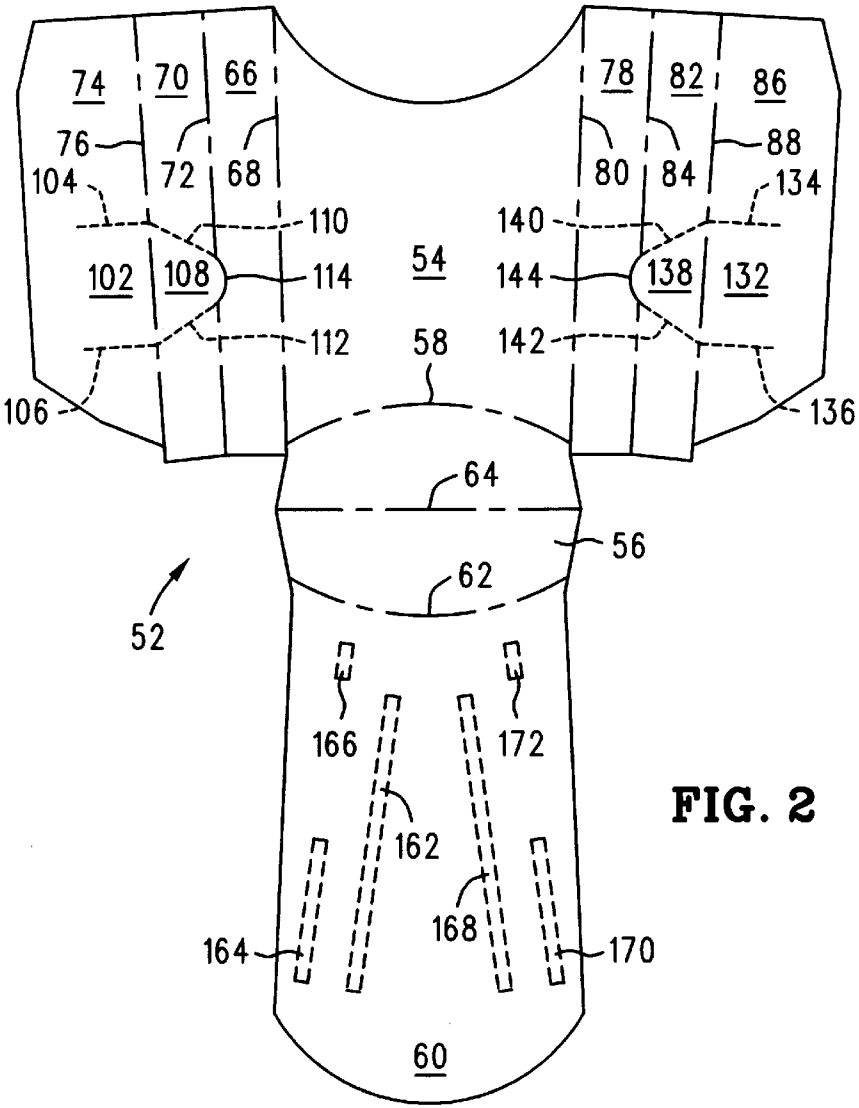
FIG. 2 is a plan view of a container blank of this invention.

In FIG. 2, there is illustrated a container blank 52 of this invention. The container blank 52 has a front panel 54, a bottom panel 56 integral with the front panel 54 and joined thereto by a fold line 58. A back panel 60 is integral with the bottom panel 56 and is joined thereto by a fold line 62. The bottom panel 56 also has a fold line 64. A sidewall panel 66 is integral with the front panel 54 and is joined thereto by a fold line 68. A sidewall panel 70 is integral with the sidewall panel 66 and is joined thereto by a fold line 72. A glue panel 74 is integral with the sidewall panel 70 and is joined thereto by a fold line 7E. A sidewall panel 78 is integral with the front panel 54 and is joined thereto by the fold line 80. A sidewall panel 82 is integral with the sidewall panel 78 and is joined thereto by a fold line 84. A glue panel 86 is integral with the sidewall panel 82 and is joined thereto by a fold line 88.

A first openable cover portion 102 is formed in the glue panel 74 by spaced apart parallel perforated lines 104 and 106. An integral extension 108 of the first openable cover portion 102 is formed in the sidewall panel 70 by converging perforated lines 110 and 112. An arcuate cut line 114 illustrated more particularly in FIG. 4A, is formed in the sidewall panel 66 and has terminal ends 116 and 118 lying in the fold line 72 to form a pull tab portion 120.

A Second openable cover portion 132 is formed in the glue panel 86 by spaced apart parallel perforated lines 134 and 136. An integral extension 138 of the second openable cover portion 132 is formed in the sidewall panel 82 by converging perforated lines 140 and 142. An arcuate cut line 144, illustrated more particularly in FIG. 4B, is formed in the sidewall panel 78 and has terminal ends 146 and 148 lying in the fold line 84 to form a pull tab portion 150. It is understood that the openable cover portions 102 and 132 and the pull tab portions 120 and 150 can be of different shapes.

While two openable cover portions are preferred, under some circumstances only one openable cover portion may be provided, as described above.

A closed container 160, FIG. 4, is formed from the container blank 52 by first folding the back panel 60 and a portion of the bottom panel 56 around the fold line 64, FIG. 3, so that a portion of the back panel 60 overlies the front panel 54 and portions of the bottom panel 56 are in a superposed relationship.

The glue panel 74 and the sidewall panel 70 are folded around the fold line 72 until the sidewall panels 66 and 70 are in a superposed relationship and the glue panel 74 overlies a portion of the back panel 60. The glue panel 74 is secured to portions of the back panel 60 by an elongated adhesive area 162 and spaced apart adhesive area 164 and 166. The adhesive areas 162, 164 and 166 are formed using a conventional suitable adhesive and conventional adhesive applying apparatus. As illustrated in FIG. 4, there is no adhesive under the first openable cover portion 102.

The glue panel 86 and the sidewall panel 82 are folded around the fold line 84 until the sidewall panels 78 and 82 are in a superposed relationship and the glue panel 86 overlies a portion of the back panel 60. The glue panel 86 is secured to portions of the back panel 60 by an elongated adhesive area 168 and spaced apart adhesive areas 170 and 172. The adhesive areas 168, 170 and 172 are formed using a conventional suitable adhesive and conventional adhesive applying apparatus. As illustrated in FIG. 4, there is no adhesive under the second openable cover portion 132. The adhesive for the adhesive areas 162, 164, 166, 168, 170 and 172 may be applied either to the glue panels 74 and 76 or to portions of the back panel 60.

Figure 5:
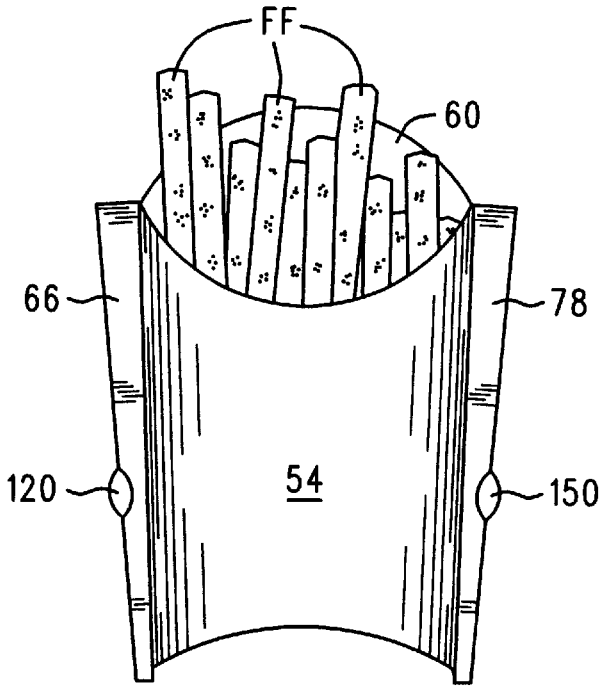
FIG. 5 is a front elevational view of an opened container filled with a desired material.

An opened container 180 is illustrated in FIG. 5 and is formed by applying an inwardly directed force on each of the fold lines 72 and 84 to move the front panel 54 and the back panel 60 apart and to separate the sidewalls 66 and 70 and the sidewalls 78 and 82. An inwardly directed force is also applied to the fold line 64 to form the bottom panel 56. The open ended container 180 is then filled with a desired material, preferably french fried potatoes FF. The filled container is sold to a customer at one of the establishments of the company conducting the contest.

Figure 6:
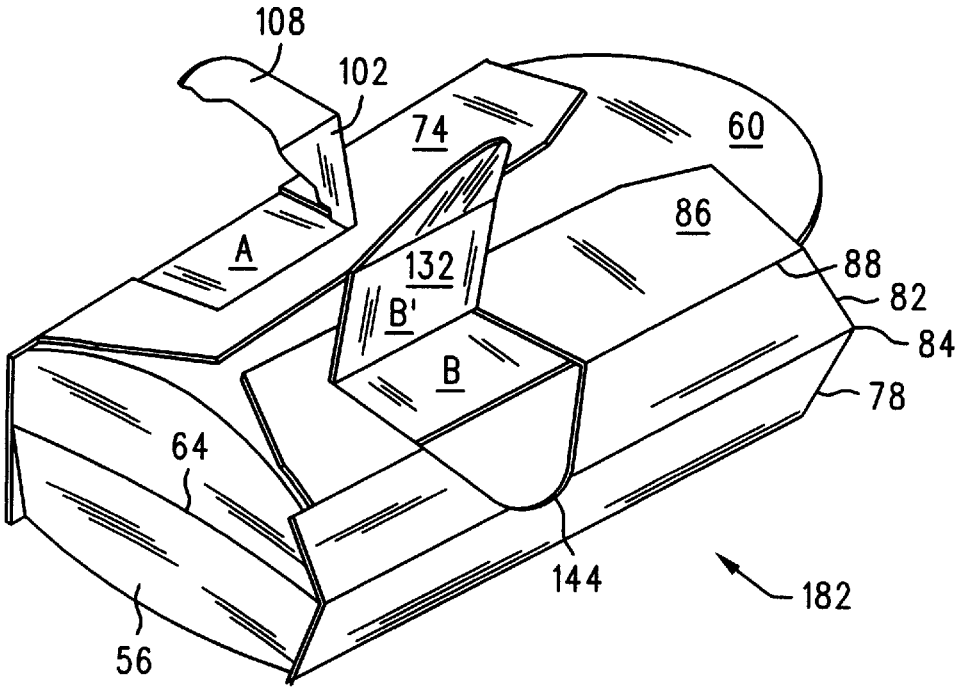
FIG. 6 is a perspective view of the opened container of FIG. 5 after the openable cover portions have been opened.

In FIG. 6, there is illustrated an empty opened container 182 with the first and second openable cover portions 102 and 132 in an opened position. The first and second openable cover portions 102 and 132 are moved to the opened positions by grasping the pull tab portions 120 and 150 and exerting a force thereon. When the first and second openable cover portions 102 and 132 have been moved to the opened position, the contest indicia A and B are revealed. The contest indicia are printed, or otherwise applied, to the portions of the back panel 60 located beneath the first and second openable cover portions 102 and 132. The contest indicia A and B can be of any desired characteristics, such as animals, flowers, people or other similar designs. A chart showing the requirements for winning a prize could be printed on the outer surface of the front panel 54 or displayed at a convenient location. One such contest could be to have a container wherein a prize is awarded if the indicium A matched the indicium B and the list would contain different prizes for different types of matching indicia. It is understood that the contest indicia could be illustrated on the surface of the openable cover portions facing the back panel as illustrated by B in FIG. 6 instead of B.

It is contemplated that the inventive concepts herein described may be variously otherwise embodied and it is intended that the appended claims be constructed to include alternative embodiments of the invention except insofar as limited by the prior art.

What is claimed:

1. A container blank for use in forming a container for participating in a potential prize awarding contest comprising:

a unitary sheet formed from a container forming material and having a plurality of cut and fold lines formed therein to form a container blank having an inner surface and an outer surface;

said container blank having a front panel portion;

a bottom panel portion integral with said front panel portion and projecting outwardly from a first portion of said front panel portion;

a back panel portion is integral with said bottom panel portion and projecting outwardly therefrom;

a first plurality of panel portions comprising at least one sidewall panel portion and at least one glue panel portion joined together by fold lines and integral with and projecting outwardly from a second portion of said front panel portion;

a second plurality of panel portions comprising at least one sidewall panel portion and at least one glue panel portion joined together by fold lines and integral with and projecting outwardly from a third portion of said front panel portion;

said outer surface of said back panel portion having at least two contest indicium illustrated thereon at spaced apart locations;

at least one openable cover portion having an outer surface with no contest indicium thereon formed in each of said first and second plurality of panel portions; and each of said openable cover portions being located to overlie one of said at least two spaced apart contest indicium when said container blank is folded and secured together to form said container.

2. A container blank as in claim 1 wherein each of said openable cover portions comprise:

a pair of spaced apart perforated lines that can be separated by the application of a sufficient force thereto;

each of said pair of spaced apart perforated lines having a first end portion and a second end portion; and a cut line extending between each of said second end portions.

3. A container blank as in claim 1 wherein:

each of said cut lines being arcuate and having opposite terminal ends to define a pull tab portion; and said opposite terminal ends of each cut line lying in one of said fold lines in said first and second plurality of panel portions.

4. A container blank as in claim 3 wherein:

each pull tab portion projecting outwardly from one of said fold lines of said first and second plurality of panel portions when said container blank is folded and secured together to form said closed container.

5. A container blank as in claim 1 wherein:

each of said first and second plurality of panel portions comprises at least two sidewall panel portions and at least one glue panel portion.

6. A container that can be opened by the application of sufficient force to spaced apart portions thereof for reception of a product and wherein portions of the container are particularly formed for participation in a potential prize awarding contest comprising:

a first layer having an inner surface and an outer surface;

a second layer joined to said first layer by spaced apart fold lines and having an inner surface and an outer surface;

a third layer joined to said first layer by spaced apart fold lines and having an inner surface and an outer surface;

at least portions of said inner surface of said third layer being secured to at least portions of said outer surface of said second layer;

said outer surface of said second layer having at least two contest indicium illustrated thereon at spaced apart locations;

at least two openable cover portions each having an outer surface having no contest indicium thereon formed in said third layer at spaced apart locations and not secured to said second layer;

each of said at least two openable cover portions being located to overlie one of said at least two spaced apart contest indicium so that said openable cover portions may be opened to disclose said at least two contest indicium;

wherein said third layer further comprises:

at least two spaced apart sections;

each of said at least two spaced apart sections comprising at least one sidewall panel portion and at least one glue panel portion joined together by a fold line;

each of said at least one sidewall panel portions being joined to said first layer by one of said spaced apart fold lines; and said glue panel portions being secured to said second layer.

7. A container as in claim 6 wherein each of said at least two openable cover portions comprises:

a pair of spaced apart perforated lines that can be separated by the application of a sufficient force thereto;

each of said pair of spaced apart perforated lines having a first end portion and a second end portion; and a cut line extending between each of said second end portions.

8. A container as in claim 7 wherein:

said first end portions are spaced apart a distance greater than said second end portions are spaced apart.

9. A container as in claim 7 wherein:

each cut line being arcuate and having opposite terminal ends to define a pull tab portion; and said opposite terminal ends of each cut line lying in one of said spaced apart fold lines.

10. A container as in claim 9 wherein:

said first end portions are spaced apart a distance greater than said second end portions are spaced apart.

11. A container as in claim 10 wherein:

each pull tab portion projecting outwardly from one of said spaced apart fold lines so that a force may be applied to said pull tab portion to open each of said openable cover portions.

* * * * *